United States Patent [19]

Arreguin

[11] 3,979,832

[45] Sept. 14, 1976

[54] SLIDING SURFACE FOR A DRAFTING BOARD

[76] Inventor: Alejandro Arreguin, 1910 Convent St., Laredo, Tex. 78040

[22] Filed: Feb. 13, 1976

[21] Appl. No.: 657,724

Related U.S. Application Data

[63] Continuation-in-part of Ser. No. 520,424, Nov. 4, 1974, abandoned.

[52] U.S. Cl. ..... 33/76 R; 33/80

[51] Int. Cl.[2] ..... B43L 5/00

[58] Field of Search ..... 33/76 R, 77, 79 R, 80

[56] References Cited

UNITED STATES PATENTS

| | | | |
|---|---|---|---|
| 280,328 | 6/1883 | Putnam | 33/76 R X |
| 1,035,755 | 8/1912 | Smith | 33/76 R |
| 1,808,359 | 6/1931 | Lewis | 33/80 |
| 1,942,727 | 1/1934 | O'Farrell | 242/67.1 D |
| 2,703,468 | 3/1955 | Sheinwald | 33/76 R X |
| 3,180,028 | 4/1965 | Roccati | 33/79 R X |
| 3,220,661 | 11/1965 | Hegedus | 242/67.1 D |

*Primary Examiner*—Charles E. Phillips
*Attorney, Agent, or Firm*—Marden S. Gordon

[57] ABSTRACT

A sliding surface for a drafting board allowing a draftsman to adjust a sheet of drawings on the drafting board by moving the drawing up and down without having to adjust or realign the drawing to maintain the square and straight lines thereof, the device consisting of a pair of oppositely wound rollers disposed in tandem spaced apart parallel relationship at the top and bottom edges of a drafting board and over which a flexible sheet of material is wound so as to overlie the top surface of the drafting board and provide a sliding surface thereon in that a sheet of drawings taped to the sliding surface will move therewith as it passes in an upward direction to roll onto the top roller and a downward direction to roll onto the bottom roller so that the top of the sheet of drawings may be brought to the bottom portion of the drafting table, and vice versa, thus allowing the draftsman to move the sheet of drawings up and down along the drafting board without having to readjust or realign the drawing sheet.

1 Claim, 5 Drawing Figures

10
11
12
13
14
15
16
17
18
19
20
20a
21
22
23
24
25
26
28
29
31
32
41
42
51
52
53
61
62
63
71
80
81
82

SLIDING SURFACE FOR A DRAFTING BOARD

This is a continuation-in-part of application Ser. No. 520,424 filed Nov. 4, 1974, now abandoned.

BACKGROUND OF THE INVENTION

1. Field of the Invention

This invention relates generally to drafting accessories and more particularly to a novel and improved sliding surface for a drafting board to allow a draftsman to move a sheet of drawings up and down along the board without having to resquare the drawings or otherwise adjust or realign the drawings when making such movement thereof on the drafting board.

2. Description of the Prior Art

It has been known in the prior art to provide drafting boards and the like to which a sheet of drawings is taped and on which a draftsman then works on the sheet of drawings by laboring over the board, it frequently being required that the draftsman stand up and bend over the board to draw at the top of the drawing sheet. To avoid this problem, many draftsmen after initially outlining the sheet of drawings will readjust the sheet to bring it downward on the drawing board and then work on the top portion of the sheet while being seated, after which the draftsman removes the sheet of drawings from the drawing board and shifts the same upward to a position where he can work on the bottom portion of the drawing sheet, this shifting of the drawing sheet requiring a realignment of the lines and squares thereof to assure accuracy thereon. This is a time consuming and somewhat frustrating job as to the moving and realigning of the drawing sheet.

Thus, while automatic drafting aids such as rules, slides, and the like have been provided as tools for the draftsman for more accurately making a drawing, there is presently no provision for a draftsman to work on a sheet of drawings in a convenient and comfortable manner without having to labor over the drawing board when working on the top portion of the drawing sheet.

SUMMARY OF THE INVENTION

The present invention recognizes the difficulties encountered by a draftsman when working on a drafting board, and provides a novel solution thereto in the form of a sliding surface for the drafting board to permit the draftsman to readjust the drawings thereon for ease of reaching any portion thereof without having to realign or readjust the drawing on the board.

It is a feature of the present invention to provide a sliding surface for a drafting board.

A further feature of the present invention provides a sliding surface for a drafting board which is relatively simple in its construction and which therefore may be readily manufactured at a relatively low cost and by simple manufacturing methods such that it can be retailed at a sufficiently low price to encourage widespread use thereof among the drafting profession.

A further feature of the present invention provides a sliding surface for a drafting board which is possessed of few parts and which therefore is unlikely to get out of order.

Still a further feature of the present invention is the provision of a sliding surface for a drafting board which is easy to use and reliable and efficient in operation.

Still yet a further feature of the present invention provides a sliding surface for a drafting board which allows a draftsman to perform faster drafting work with less physical work on the part of the draftsman, eliminates the draftsman having to continually stand up and bend over the drawing board to draw at the top of the drawing sheet positioned thereon, eliminates backache and leg aches of the draftsman, and eliminates any need of readjusting or realigning a sheet of drawings when repositioning the same on the drafting board for ease of access thereto.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figures 1, 2, 3, 4, 5:
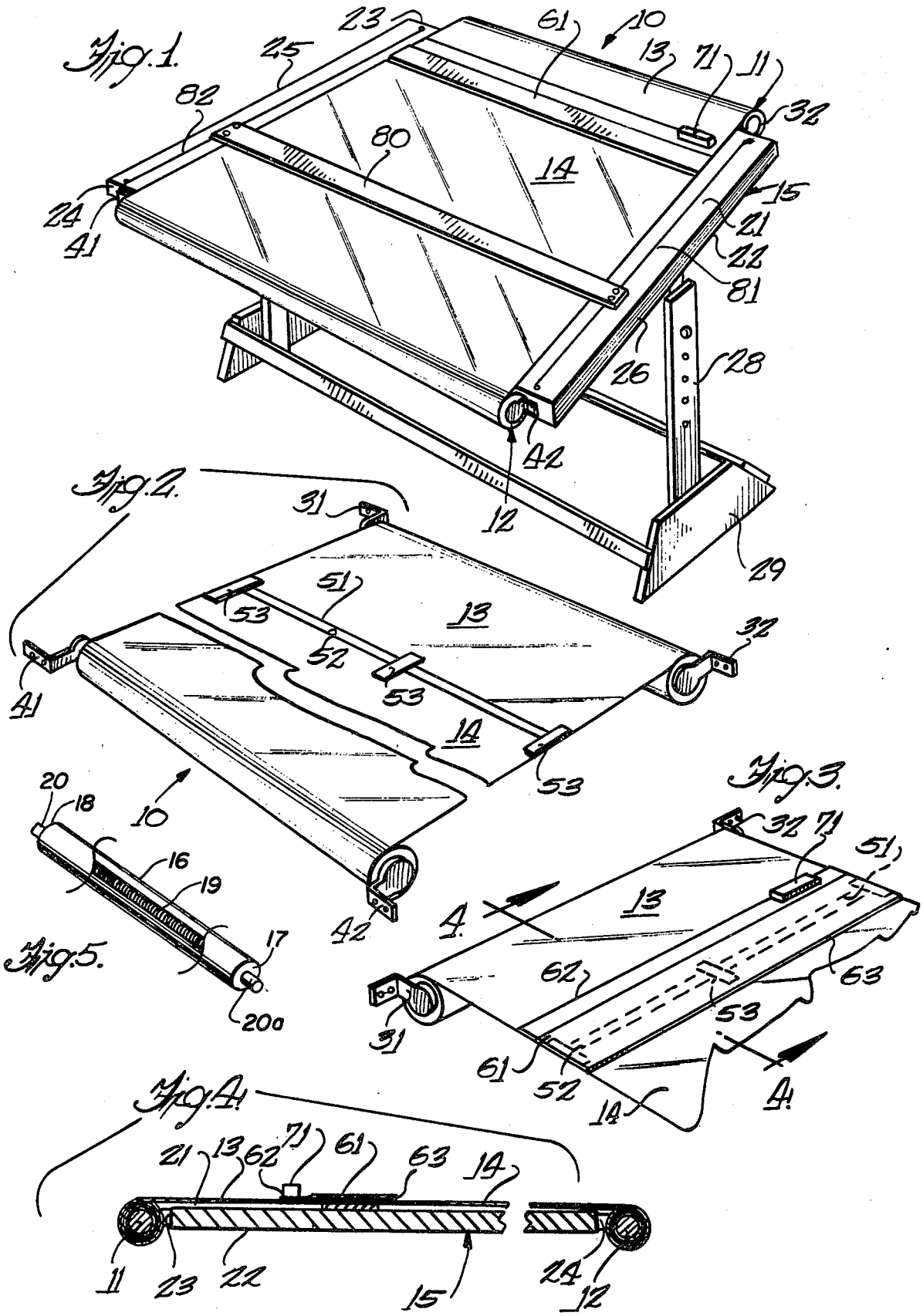
FIG. 1 is a perspective view of a drafting board having the sliding surface thereon in accord with the present invention.
FIG. 2 is a fragmentary perspective view of the sliding surface of the invention.
FIG. 3 is a fragmentary perspective view of a portion of the sliding surface of the invention.
FIG. 4 is a cross-sectional view taken along line 4—4 of FIG. 3.
FIG. 5 is a perspective view of one of the rollers.

Referring now to the drawings in detail, there is illustrated a preferred form of a sliding surface for a drafting board constructed in accordance with the principles of the present invention and which is designated generally in its entirety by the reference numeral 10 and which is comprised of a top roller 11, a bottom roller 12, and sheets of flexible film like material 13 and 14.

The invention is illustrated as used on drafting board 15 which is of an elongated flat rectangular configuration having a flat top surface 21, a flat bottom surface 22, opposed top and bottom flat edges 23 and 24, and opposed flat side edges 25 and 26. The drafting board 15 is supported in a suitable manner on vertical posts 28 providing for a vertical adjustment of the board, the posts in turn supported on base frame 29.

Each of the rollers 11 and 12 are identical with roller 11 being shown in FIG. 5 having a hollow longitudinally elongated cylindrical body member 16 with opposite ends 17 and 18. A concentrically coiled spring 19 extends axially through the body member having one end permanently affixed inside end 17 with its opposite end journaled for rotation in end 18 and joined to a shaft 20 of rectangular cross-section extending outwardly of end 18. A cylindrical boss **20*a* extends outwardly of end 17. Roller 11 is mounted between a pair of brackets 31 and 32 while bottom roller 12 is mounted between a pair of brackets 41 and 42, the bottom roller oriented one hundred eighty degrees out of phase from the top roller such that shaft 20 of roller 11 engages bracket 31 while shaft 20 of roller 12 engages bracket 42. In this manner the spring 19 of each of the rollers are oppositely biased to each other, with the springs biasing the rollers to rotate in directions opposite to each other. Each of the brackets 31, 32, 41 and 42 are of a general L-shaped configuration, with brackets 31 and 32 adapted to be mounted by screws to the top edge 23 of drawing board 15 while brackets 41 and 42** are adapted to be mounted by screws to the bottom edge 24 of the board 15 and in alignment with respective ones of the brackets 31 and 32 as illustrated.

Roller 11 is rotatively supported between the brackets 31 and 32 adjacent the top edge 23 of the board 15. Roller 12 is rotatively supported between brackets 41 and 42 adjacent bottom edge 24 of the board 15 and is disposed in parallel spaced apart tandem relationship with roller 11. The springs 19 inwardly of each of the rollers are affixed to each of their associated shafts 20 which engages bracket 31 for roller 11 and bracket 42 for roller 12 such that the rollers are wound in opposite directions about their axis relative to each other.

Wrapped about roller 11 is the first sheet of material 13 which is manufactured of a thin flexible vinyl material extending the width of the roller and which is of a sufficient length to extend from roller 11 completely over board top surface 21 to the bottom edge 24 thereof. Wrapped about roller 12 is a second sheet of material 14 extending the width of the roller and which is of a thin polyester film material and which is of a sufficient length to be unwound from the bottom roller 12 and, while still affixed thereto, extend over the complete top surface 21 of the drafting board 15 to the top edge 23 thereof.

The adjacent free edges 51 and 52 of sheets 13 and 14 respectively are disposed in parallel confronting relationship and secured together by means of a plurality of tape strips 53 having a coating of pressure sensitive adhesive on one surface and which extend between the sheets 13 and 14. The use of two separate sheets allows for the accurate alignment of the rollers on the board, with any misalignment being readily determined and corrected. It also allows for the inexpensive replacement of the sheets and roller since each roller is provided with its sheet.

Affixed to top sheet 13 on the top surface thereof adjacent edge 51 is an elongated flat rectangular flap 61 which defines a bridge over the confronting edges 51 and 52 and which is adhesively secured by a thin strip of adhesive material disposed along its top edge 62 to the top surface of sheet 13 and extends normal to the longitudinal axis of the sheet and terminates at bottom edge 63 which overlaps sheet 14. The flap 62 rests on the top surface of the tape strips 53.

An elongated rectangularly shaped solid box-like pull member or pull block 71 is formed of a wood or plastic material which is glued to the top surface of top sheet 13 adjacent a corner edge of flap 61 by means of an adhesive coating disposed completely along a bottom surface of the pull block and is intended for use by a draftsman when effecting the shifting of the sheets 13 and 14 along the top surface 21 of the drafting board 15. In this regard, it is to be understood that the combined sheets 13 and 14 act together to define the sliding surface over the drafting board 15.

As the rollers 11 and 12 are of the continuous spring return type, and as they are oppositely wound about their axis, they maintain an equal and opposite pull on the sheets 13 and 14 such that they are maintained in stationary position on the drafting board 15 until physically moved by the exertion of an external force by the draftsman through use of the pull block 71.

In operation, a draftsman places a sheet of drawing paper onto the surface 14 after the surface 14 is unwound from roller 12 to extend over the major portion of the drafting board top surface 21 so as to lie beneath a straight edge 80 slidable along wire guides 81 and 82 in the normal manner. The sheet is taped in position in the normal fashion onto the sheet 14 by use of drafting tape and the like. By pulling down on pull block 71 the draftsman is now able to move the drawing sheet downward along the drafting board 15 to the bottom edge thereof such that the top part of the drawing sheet may be moved to the bottom part of the drafting board with such movement maintaining the sheet in adjustment so that there is no requirement on the draftsman to realign and re-square the sheet to maintain the straight horizontal and vertical angular lines thereon. As work progresses on the sheet, the draftsman merely moves the sliding surfaces 13, 14 upward by means of pull block 71 in a manner to reposition the sheet of drawings in any desired manner therealong. Thus, the draftsman may move the sheet of drawings up and down along the surface of the drawing board without having to adjust or realign the drawing, this eliminating the need for the draftsman from having to stand up and bend over the drafting board when drawing at the top part of the sheet of drawing such that the draftsman may do faster work with less physical work involved as to standing and bending so that a draftsman may eliminate some of the backache and leg aches frequently encountered by individuals practicing the drafting profession.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size, and arrangement of parts may be resorted to without departing from the spirit of the invention, the scope of the novel concepts thereof, or the scope of the sub-joined claims.

Having thus described the invention, what is claimed is:

1. A sliding surface device for use on a drafting board said drafting board having a flat top surface and opposed flat parallelly extending top and bottom edges, the sliding surface device comprising, in combination:

a first longitudinally elongated cylindrical roller having a spring disposed integrally therewith to spring bias the roller for rotation about its longitudinal axis in one direction;

a second longitudinally elongated cylindrical roller identical to said first roller and having a spring disposed integrally therewith to spring bias the roller for rotation about its longitudinal axis in a direction opposite to the direction of rotation of the first roller, said second roller being of an identical size, configuration and structure to said first roller;

a first pair of brackets adapted to be mounted to opposite ends of the top edge of the drafting board to engage and support opposite ends of the first roller in a position adjacent the drafting board top edge and extending parallel thereto;

a second pair of brackets adapted to be mounted to opposite ends of the bottom edge of the drafting board to support opposite ends of the second roller to position the second roller adjacent the bottom edge of the drafting board extending parallel thereto;

said first roller and said second roller being supported by said first pair of brackets and said second pair of brackets in tandem spaced apart parallel relationship;

a first sheet of flat thin flexible vinyl material extending the width of the first roller and having one end edge secured thereto with said sheet being rolled about the roller and terminating in a leading free end edge;

a second sheet of flat flexible thin polyester film type material extending the width of the second roller and having one end affixed permanently to the second roller with the sheet being rolled thereabout and extending outwardly therefrom and terminating in a leading free edge thereof, said second sheet being of the same width as said first sheet with said leading free edge of said second sheet being disposed parallel to and immediately adjacent to said leading edge of said first sheet;

a plurality of transversely spaced apart longitudinally extending tape strips each having a coating of pressure sensitive adhesive on one surface thereof and positioned at spaced apart intervals overlapping the adjacent free edges of said first and second sheets and adhesively gripping the top surfaces of said first and second sheets to bridge the gap therebetween and secure said sheets together to define an overall sliding surface;

a flat rectangularly elongated strip of flexible material having a length overlapping the total length of each of said tape strips and having a width equal to the width of said first and second sheets of material, said strips having a flat top surface and a flat bottom surface;

an adhesive material disposed in a thin strip along the top edge of the bottom surface of said elongated strip to adhesively connect the strip of material transversely of said first sheet of material to define a flat member bridging said tape strips and said gaps between said first and said second sheets of material;

an elongated rectangularly shaped solid box-like pull member having a flat top surface and a flat bottom surface; and an adhesive coating disposed completely along said bottom surface of said pull member permanently securing said pull member to said first sheet of material in a position immediately adjacent said flat member, said pull member projecting upwardly from the top surface of said sheet of material to be readily grasped in a hand of an individual utilizing the sliding surface device to effect simultaneous movement of said sheet of material along the top surface of the drafting board with said spring biased rollers retaining said first and second sheets of material continually taut in all positions thereof.

* * * * *